US005864084A

United States Patent [19]

Yu et al.

[11] Patent Number: 5,864,084

[45] Date of Patent: Jan. 26, 1999

[54] GLOW IN THE DARK FUSE AND METHOD FOR MAKING SAME

[75] Inventors: Peter Sung Yan Yu, Florence, Ala.; Charles Eugene Beatty, Columbus, Miss.

[73] Assignee: American Promotional Events, Inc., Florence, Ala.

[21] Appl. No.: 843,514

[22] Filed: Apr. 16, 1997

[51] Int. Cl.[6] ..... F42B 4/00; C06C 5/00; C06C 5/06

[52] U.S. Cl. ..... 86/20.1; 86/1.1; 102/275.1; 102/275.9

[58] Field of Search ..... 102/275.1, 275.8, 102/275.9, 275.11, 293, 335, 361, 355, 356, 347, 200; 89/1.1; 86/1.1, 20.1, 22; 149/100, 98, 123

[56] References Cited

U.S. PATENT DOCUMENTS

| | | | |
|---|---|---|---|
| 757,580 | 4/1904 | Truyter et al. | 86/22 |
| 1,517,878 | 12/1924 | Wasmayr | 102/275.1 |
| 2,239,052 | 4/1941 | Pearsall et al. | 102/275.1 |
| 2,376,813 | 11/1945 | Robins et al. . | |
| 2,382,355 | 8/1945 | Warren, Jr. . | |
| 2,939,271 | 6/1960 | Nadel . | |
| 3,474,730 | 10/1969 | Sheeran | 149/123 |
| 3,683,742 | 8/1972 | Rohde et al. | 102/275.1 |
| 3,737,349 | 6/1973 | Levenson | 149/123 |
| 3,772,099 | 11/1973 | Ryan et al. | 149/123 |
| 3,835,782 | 9/1974 | Griffith et al. | 149/123 |
| 3,908,509 | 9/1975 | Kelly et al. | 102/275.9 |
| 4,131,064 | 12/1978 | Ryan et al. | 149/123 |
| 4,177,732 | 12/1979 | Steele | 86/22 |
| 4,209,823 | 6/1980 | Burkdoll | 102/336 |
| 4,230,041 | 10/1980 | Bailey et al. | 86/1.1 |
| 4,310,324 | 1/1982 | Aitken | 86/1.1 |
| 4,640,035 | 2/1987 | Kind et al. | 149/123 |
| 4,697,518 | 10/1987 | Lau et al. | 102/361 |
| 4,724,327 | 2/1988 | Mitchell . | |
| 5,343,808 | 9/1994 | Collar | 102/361 |

*Primary Examiner*—Charles T. Jordan
*Assistant Examiner*—Theresa M. Wesson
*Attorney, Agent, or Firm*—Blackwell Sanders Peper Martin

[57] ABSTRACT

A glow in the dark firework device and a method for making same is disclosed. The firework device (10) includes a body (12) having an outer body surface (14), and a glow in the dark fuse (18) passing from the inner body surface (7) of body (12) to the outer body surface (14) of body (12) of firework device (10). Fuse (18) is comprised of a fuse body (16), and a plurality of threads (20,22,26–45) having an ignitable substance (25) dispersed among the plurality of threads (20,22,26–45). The outer fuse surface (9) of fuse (18) has a phosphorescent solution (52) applied thereto.

9 Claims, 3 Drawing Sheets

GLOW IN THE DARK FUSE AND METHOD FOR MAKING SAME

FIELD OF THE INVENTION

The present invention relates to fireworks and methods for making same. More particularly, the present invention relates to a glow in the dark fuse for fireworks.

BACKGROUND OF THE INVENTION

Gross firework sales in the United States are estimated at approximately $350 million dollars each year. This figure represents several billion individual firework items and several thousand firework displays. Every year, people are injured while setting off fireworks, particularly around the 4th of July holiday. The U.S. Consumer Product Safety Commission estimates that there have been approximately 7,350 fireworks-related injuries per year and usually one or two deaths associated with fireworks.

One main reason for such injuries is the fact that fireworks are used in the evening when it is dark outside. It is often difficult for users to locate the fuse of the firework device. Tile inability to properly locate the fuse may also cause the user to light the fuse improperly, such as too close to the firework device. As a result, the user may not have sufficient time to walk away from the shooting firework device and may cause him or her serious bodily injury. As a result, there continues to be a long-felt need for a firework which avoids these pitfalls and which is thus safer to use.

Glow in the dark devices are not new. U.S. Pat. No. 4,724,327 discloses a welt cord which is either saturated in luminescent paint or embedded with a luminescent material. Depending on the type of luminescent material used, the cord glows either after having been excited by a light source or while being excited by light of a suitable wavelength. U.S. Pat. No. 2,939,271 discloses a phosphorescent rope comprising a plurality of strands of fibers and a plurality of phosphorescent filaments wound through and along the strands of fiber. Each of the filaments is made up of a pair of thin, narrow strips of plastic bonded together and a layer of phosphorescent material sandwiched between the plastic strips. U.S. Pat. No. 2,382,355 discloses a rope that is either coated with a luminous material or that has luminous material incorporated in the material from which the rope is made. U.S. Pat. No. 2,376,813 discloses a floatable, water repellant/resistant rope that may be coated with a luminescent material to increase its ability to be seen in the dark.

None of these patents, however, disclose, teach or suggest a glow in the dark fuse or a firework device having a glow in the dark fuse. Not only are there structural differences between the fuse of the present invention and the above-mentioned cords and ropes, but the luminous material must be applied in a unique and different manner so as not to degrade or impede the performance of the fuse and the firework device. Moreover, existing firework devices do not currently have any mechanisms to aid users to accurately locate the fuse in the dark. In light of the unsafe nature of these existing firework devices, there is a need for a firework device having a fuse which can be easily detected in the dark.

SUMMARY OF THE INVENTION

The present invention fulfills the need for safer fireworks. More particularly, one aspect of the invention relates to a firework device comprising a body having an outer body surface and a glow in the dark fuse connected to the outer body surface of the firework device. The fuse is comprised of a plurality of threads, and an ignitable substance dispersed among the plurality of threads. The outer surface of the fuse has a phosphorescent solution applied thereto. The phosphorescent solution comprises a mixture of a phosphorescent powder and nitrocellulose. Preferably, the phosphorescent powder is approximately 2 ounces in weight and the nitrocellulose is approximately one gallon in weight.

Another aspect of the present invention is directed to the fuse itself.

Yet another aspect of the invention relates to a method of making a glow in the dark fuse for a firework device. The method comprises the steps of applying a first layer of a phosphorescent solution to the outer surface of the fuse, and then drying the first layer of the phosphorescent solution. Preferably, the method further comprises the steps of applying a second layer of the phosphorescent solution to the first layer of the phosphorescent solution, and drying the second layer of the phosphorescent solution. The step of applying the first layer of phosphorescent solution comprises the step of feeding the fuse into a container containing the phosphorescent solution. The method further comprises the step of feeding the fuse from the container through a tunnel containing heat, the tunnel preferably being approximately 50 feet in length. The phosphorescent solution applied to the outer surface of the fuse preferably comprises a mixture of a phosphorescent powder and nitrocellulose and more preferably in the ratio of approximately 2 ounces phosphorescent powder to one gallon nitrocellulose. The first and second layer of phosphorescent solution are preferably dried via heat to a temperature of approximately 120° degrees Fahrenheit.

BRIEF DESCRIPTION OF THE DRAWINGS

In the drawings, where like numerals refer to like features throughout the several views.

DETAILED DESCRIPTION OF THE PREFERRED EMBODIMENT

The present invention concerns a firework device having a glow in the dark fuse. The fuse comprises an outer surface having a phosphorescent solution applied thereto. The phosphorescent solution comprises a mixture of a phosphorescent powder and nitrocellulose, preferably in the ratio of two ounces phosphorescent powder for each gallon of nitrocellulose. The phosphorescent solution is applied to the outer surface of the fuse, preferably in at least two layers. By providing such a fuse, a safe and yet high performance firework is achieved.

Figure 1:
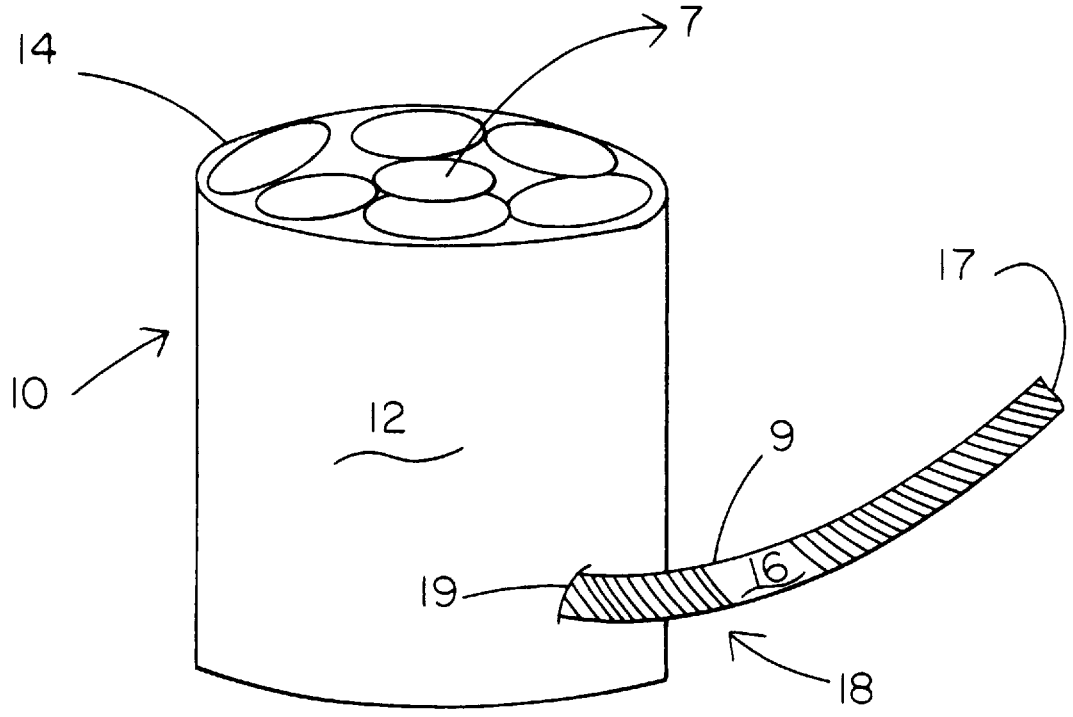
FIG. 1 is a perspective cross sectional view of a firework device according to the present invention.

Referring now to FIG. 1, a firework device 10 is shown. Firework device 10 comprises a body 12 having an inner body surface 7 and an outer body surface 14, and a fuse 18 comprising a fuse body 16 having a top end 17 and a bottom end (not shown) and an outer fuse surface 9. Bottom end of fuse 18 passes from inner body surface 7 of body 12 through an aperture 19 in outer body surface 14 of firework device 10 and extends a predetermined distance therefrom. Firework device 10 is ignited by applying a flame (not shown) to top end 17 of fuse 18. Fuse 18 is preferably at least 1–⅞ inches long so that it takes at least 5 seconds from the time top end 17 is lit until firework device 10 "goes off".

Figure 2:
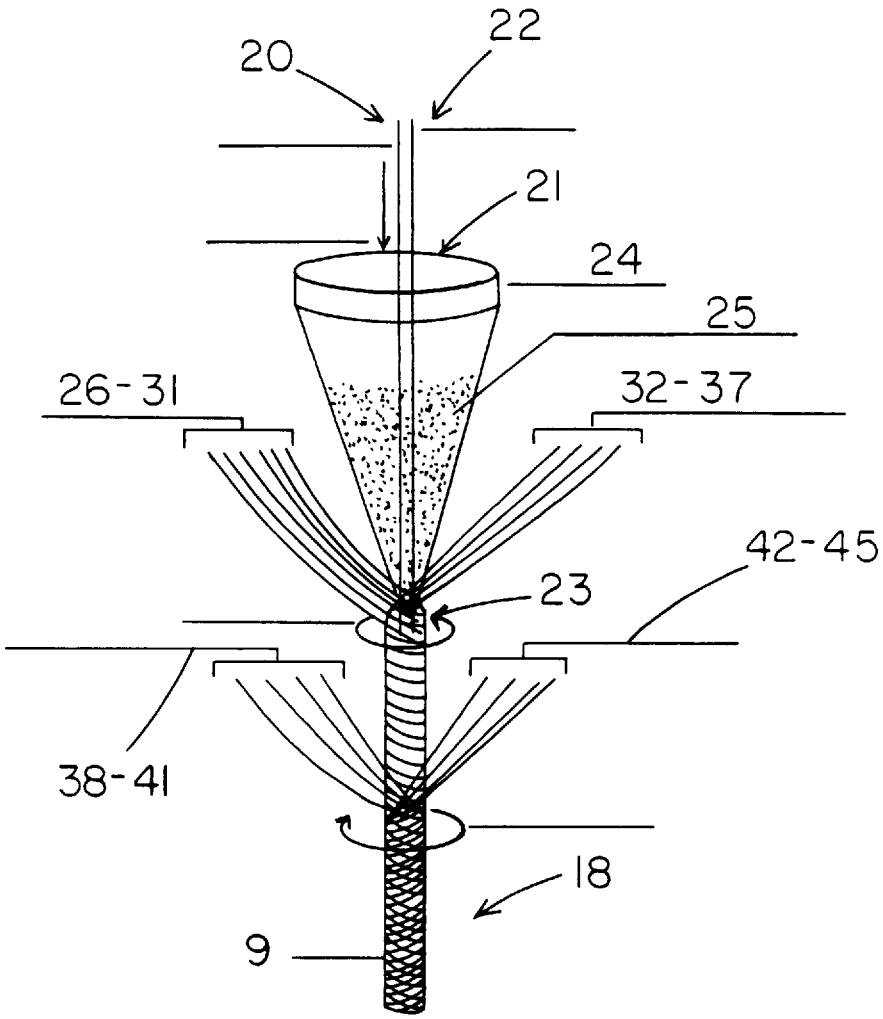
FIG. 2 is a diagram showing how the fuse of the firework device of FIG. 1 is made in accordance with the present invention.

FIG. 2 shows a method for making fuse 18. Fuse 18 is comprised of several threads, preferably twenty-two (22) in total. Threads 20 and 22 are fed from the thread holder on a fuse machine (not shown) into a funnel 24. Funnel 24 has an opening 21 for receiving threads 20 and 22 and a smaller opening 23 through which threads 20 and 22 exit. Funnel 24 contains a black powder which is applied to threads passing therethrough. The black powder may be any substance that is ignitable such as, for example charcoal, potassium prechorlate, and Sulfur.

Threads 26–31 and threads 32–37 from the thread holder of the fuse machine are then wound, preferably in a counter-clockwise manner, to help keep the black powder on threads 20 and 22 as they exit opening 23 of funnel 24. Once threads 26–37 have been wound, threads 38–41 and threads 42–45 from the thread holder of the fuse machine are then in turn wound around threads 26–37, preferably in a clockwise manner to create an outer wrap. It can be understood by one skilled in the art that the number of threads used and the direction of the winding are not critical. However, it is preferred that the winding of threads 26–37 be done in a direction that it different than the winding of threads 38–45 so as to give additional strength to fuse 18.

Figure 3:
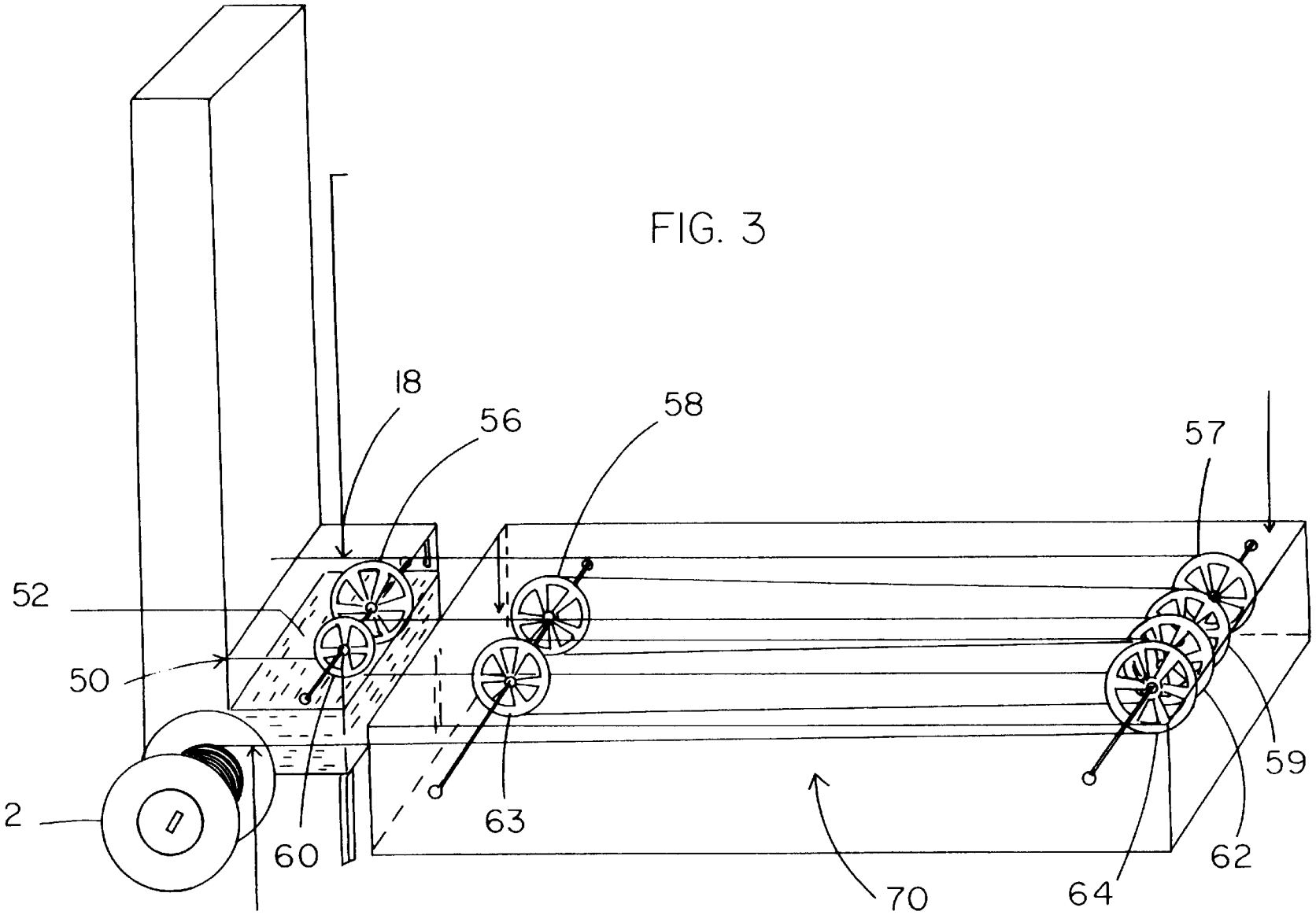
FIG. 3 is a diagram showing the process of applying a phosphorescent solution to the fuse of FIG. 2 in accordance with the present invention.

FIG. 3 shows a method of making a glow in the dark fuse in accordance with the present invention. In particular, fuse 18 is fed from a container 50 containing a phosphorescent solution 52 for applying to fuse 18 through a tunnel 70 containing heat for drying phosphorescent solution 52 applied to fuse 18. Phosphorescent solution 52 preferably is comprised of materials such that it remains on fuse 18 once applied thereto. In addition, phosphorescent solution 52 preferably does not impede with the ignitable nature of fuse 18. In one embodiment, phosphorescent solution 52 comprises a mixture of phosphorescent powder and nitrocellulose. In a more preferred embodiment, the phosphorescent powder and nitrocellulose are in a ratio of two ounces to one gallon, respectively. Of course, it can be appreciated by one skilled in the arts that this ratio is not critical but should merely allow for the phosphorescent material to remain on outer fuse surface 9 of fuse 18 once applied thereto, while not impeding the ignitability of fuse 18.

Fuse 18 is fed into container 50 via a first wheel 56 positioned within container 50 such that a first layer of phosphorescent solution is applied to the outer fuse surface 9 of fuse 18. First wheel 56 is in communication with second, third, and fourth wheels 57, 58 and 59, respectively positioned within tunnel 70 which contains heat for drying the first layer of phosphorescent solution onto the outer fuse surface 9 of fuse 18. In a preferred embodiment, tunnel 70 is fifty (50) feet in length and is heated to a temperature of approximately 120° degrees Fahrenheit. In particular, fuse 18 is fed from first wheel 56 to second wheel 57 and then back to third wheel 59. From third wheel 59, fuse 18 is fed back to a fifth wheel 60 positioned within container 50 wherein a second layer of phosphorescent solution is applied to fuse 18. Tunnel 70 further contains sixth, seventh and eighth wheels 62, 63 and 64, respectively positioned therein for feeding and drying the second layer of phosphorescent solution onto outer fuse surface 9 of fuse 18 as it travels within tunnel 70. In particular, fuse 18 is fed from fifth wheel 60 to sixth wheel 62 and then to seventh wheel 63 and then to eighth wheel 64. From eight wheel 64, fuse 18 is fed from tunnel 70 to a spindle 2. While FIG. 3 shows two layers of phosphorescent solution being applied to fuse 18 and being fed twice through tunnel 70 for drying, it can be understood by one skilled in the arts that only one layer of phosphorescent solution need be applied to fuse 18 an that it only need be dried once. Likewise, a plurality of phosphorescent layers may be applied to fuse 18 and dried a plurality of times.

The foregoing constitutes a description of various features of a preferred embodiment. Numerous changes to the preferred embodiment are possible without departing from the spirit and scope of the invention. Hence, the scope of the invention should be determined with reference not to the preferred embodiment, but to the following claims.

We claim:

1. A method of making a glow in the dark fuse for a firework device, the fuse having an outer fuse surface, comprising the steps of:

applying a first layer of a phosphorescent solution to the outer fuse surface of the fuse;

drying the first layer of the phosphorescent solution onto the outer fuse surface of the fuse;

applying a second layer of the phosphorescent solution to the first layer of the phosphorescent solution; and drying the second layer of the phosphorescent solution onto the first layer of the phosphorescent solution.

2. The method of claim 1, wherein the step of applying comprises the step of feeding the fuse into a container containing the phosphorescent solution.

3. The method of claim 2, further comprising the step of feeding the fuse from the container to a tunnel containing heat.

4. The method of claim 3, wherein the tunnel is approximately 50 feet in length.

5. The method of claim 1, wherein the phosphorescent solution comprises a mixture of a phosphorescent powder and nitrocellulose.

6. The method of claim 5, wherein the phosphorescent solution applied to the outer fuse surface is made from a solution comprising approximately two ounces of the phosphorescent powder and approximately one gallon of the nitrocellulose.

7. The method of claim 1, wherein the step of drying is done by heat.

8. The method of claim 1, wherein the step of drying is done by heat and the temperature to which the first layer of phosphorescent solution is heated is approximately 120° degrees Fahrenheit.

9. The method of claim 1, wherein the step of drying is done by heat and the temperature to which the second layer of phosphorescent layer is heated is approximately 120° degrees Fahrenheit.

* * * * *